US007313054B2

(12) United States Patent
Matthey et al.

(10) Patent No.: US 7,313,054 B2
(45) Date of Patent: Dec. 25, 2007

(54) POSITIONING AND LOCKING MECHANISM OF DISPLAY MEANS IN A PORTABLE ELECTRONIC APPARATUS

(75) Inventors: Gérald Maurice Matthey, Ballaigues (CH); Pascal Robert, Tramelan (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 58 days.

(21) Appl. No.: 11/076,421

(22) Filed: Mar. 10, 2005

(65) Prior Publication Data

US 2005/0201210 A1 Sep. 15, 2005

(30) Foreign Application Priority Data

Mar. 11, 2004 (EP) ..... 04101004

(51) Int. Cl.
*G04B 19/00* (2006.01)
*G04B 19/06* (2006.01)

(52) U.S. Cl. ..... 368/223; 368/236

(58) Field of Classification Search ..... 368/223, 368/236.314, 316
See application file for complete search history.

(56) References Cited

U.S. PATENT DOCUMENTS 3,983,689 A 10/1976 Burke et al.
4,012,117 A 3/1977 Lazzery
4,020,627 A * 5/1977 Yoshida et al. ..... 368/84
4,044,542 A * 8/1977 Burke ..... 368/242
4,213,295 A * 7/1980 Perrot ..... 368/236
4,218,872 A * 8/1980 Ikegami ..... 368/82
4,247,926 A * 1/1981 Bachmann ..... 368/28

FOREIGN PATENT DOCUMENTS

EP 0545229 A 6/1993

OTHER PUBLICATIONS

European Search Report, completed Sep. 1, 2004.

* cited by examiner

*Primary Examiner*—Vit Miska
*Assistant Examiner*—Thanh S. Phan
(74) *Attorney, Agent, or Firm*—Griffin & Szipl, P.C.

(57) ABSTRACT

The invention concerns a portable electronic apparatus (50) including a dial (52) provided with at least one aperture (54), a support piece (1), fixed in relation to the dial, arranged for receiving display means (2). The support piece has at least first (5*a*-5*b*) and second (6*a*-6*b*) bearing surfaces defining a fixed position for the display means in the support piece in relation to the aperture in the dial, the fixed position being defined in a parallel plane to the dial.

First (7), respectively, second (8) mechanical means are provided for moving the display means in abutment against the first, respectively, second bearing surfaces, in the fixed position that they define.

10 Claims, 2 Drawing Sheets

POSITIONING AND LOCKING MECHANISM OF DISPLAY MEANS IN A PORTABLE ELECTRONIC APPARATUS

This application claims priority from European Patent Application No 04101004.2 filed Mar. 11, 2004, the entire disclosure of which is incorporated herein by reference.

FIELD OF THE INVENTION

The present invention concerns, generally, a system for positioning and locking display means in a portable electronic apparatus. The invention concerns more specifically the mechanical means implemented in order to position and lock a liquid crystal cell opposite an aperture made through the dial of a watch. The invention also concerns a method for mounting a display module in a portable electronic apparatus.

BACKGROUND OF THE INVENTION

It is common in the field of horology to manufacture electronic watches, an example embodiment of which is shown in FIG. 5. Such a watch 50 conventionally comprises a case 51 including a back cover and closed on top by means of a glass, said case containing a watch movement controlled by an electronic circuit, that are not shown, a dial 52 carrying time indicating means, for example hands 53 driven by the gear trains of the watch movement. Dial 52 includes an aperture 54 for making visible display means 55, such as for example a liquid crystal display or LCD.

Traditionally, display means 55 are mounted on a support piece, not visible in this Figure, disposed underneath the dial and fixed with respect thereto. The support piece includes a pattern cavity for receiving display means 55 and positioning them in relation to aperture 54 made in dial 52 so that they are visible through dial 52 via aperture 54. Once display means 55 have been positioned in the pattern cavity provided for such purpose, a light guide or a holding plate is placed on top then sealed onto the support piece preventing any movement of display means 55 along an axis perpendicular to the mid-plane of the support piece.

There is also known from the prior art, particularly from U.S. Pat. No. 4,218,872, a watch comprising a stop element used for determining the position of the dial in relation to that of an electro-optical cell. It will be noted however that no mechanical means are provided that can be actuated by a user in order to move the display means against the stop element.

Nonetheless, it has been observed that the conventional methods for positioning display means 55 do not, on the one hand, allow precise positioning of the display means to be obtained in relation to aperture 54 made in watch dial 52, particularly because it is necessary to have a play between the size of the pattern cavity and display means 55 to prevent any excessive mechanical stress on the latter, and, on the other hand, such methods do not allow the position of said display means to be maintained properly during the operation of securing of the light guide.

In these conditions, the securing operation is thus carried out with approximate positioning of the display means. Thus, a certain number of watches 50 have a dial 52 with an aperture 54 through which display means 55 are visible positioned askew, which consequently greatly affects the aesthetic appearance of such watches, which is evidently undesirable. It is also undesirable to keep only those watches having a suitable aesthetic appearance at the prices of significantly decreasing the production line yield.

SUMMARY OF THE INVENTION

In order to overcome the drawbacks of the prior art, the idea according to the invention consists in providing precise positioning means and means for locking the display means, in order to be able to easily secure a light guide above the display means for a secure, precise positioning of the latter, in a parallel plane to the dial, in relation to the aperture which is made therein.

The present invention therefore concerns a portable electronic apparatus the features of which include a case, a dial provided with at least one aperture, a support piece fixedly mounted in the case in relation to the dial along a substantially parallel plane to the mid-plane of the dial, arranged for receiving display means, the support piece having at least first and second bearing surfaces defining a fixed position for the display means in the support piece in relation to the aperture in the dial, first, respectively, second mechanical means for moving the display means in abutment against the first, respectively second bearing surfaces, in the fixed position that the surfaces define, wherein at least one of the first or second mechanical means are formed by mechanical means for converting a movement of rotation into a movement of translation.

Advantageous embodiments of the present invention form the subject of the dependent claims.

The invention also concerns the method of mounting a display module in a portable electronic apparatus, display module comprising display means and a light guide in a portable electronic apparatus according to the above portable apparatus embodiment, wherein the method includes the following steps: (a) arranging the display means on the support piece; (b) actuating one of the first or second mechanical means to move the display means in abutment against the corresponding bearing surface or surfaces; (c) actuating the other of the first or second mechanical means to move the display means in abutment against the other corresponding bearing surface or surfaces, wherein the mechanical means are cams, and wherein the steps of actuating the mechanical means correspond to the following steps: (i) rotating one or other of the cams to move the display means in abutment against the corresponding bearing surface or surfaces; and (ii) rotating the other cam to move the display means in abutment against the corresponding other bearing surface or surfaces.

BRIEF DESCRIPTION OF THE DRAWINGS

Other features and advantages of the present invention will appear more clearly upon reading the following detailed description of embodiments of the invention given solely by way of non-limiting example and illustrated by the annexed drawings, in which.

DESCRIPTION OF PREFERRED EMBODIMENTS

The invention concerns, as previously mentioned, a portable electronic apparatus comprising a dial in which an aperture is made, through which display means are visible. This apparatus also includes an electronic control circuit, for controlling the display means, advantageously formed by a liquid crystal display (LCD). These display means can provide the user of the watch with, for example, a time indication, but also with other types of information, like for example, an alarm time, the ambient temperature, atmospheric pressure, etc.

Figure 5:
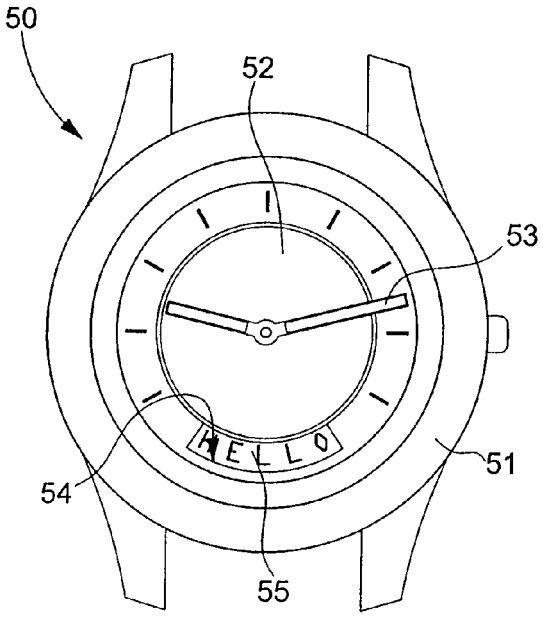
PRIOR ART Fig. 5
FIG. 5, already described, shows an example watch with a dial exhibiting an aperture.

In the following description, the portable electronic apparatus concerned is preferably an electronic watch, an example embodiment of which is provided in FIG. 5, although the invention can be applied to other portable electronic apparatus, like for example a cellular telephone or portable electronic games.

Figure 1:
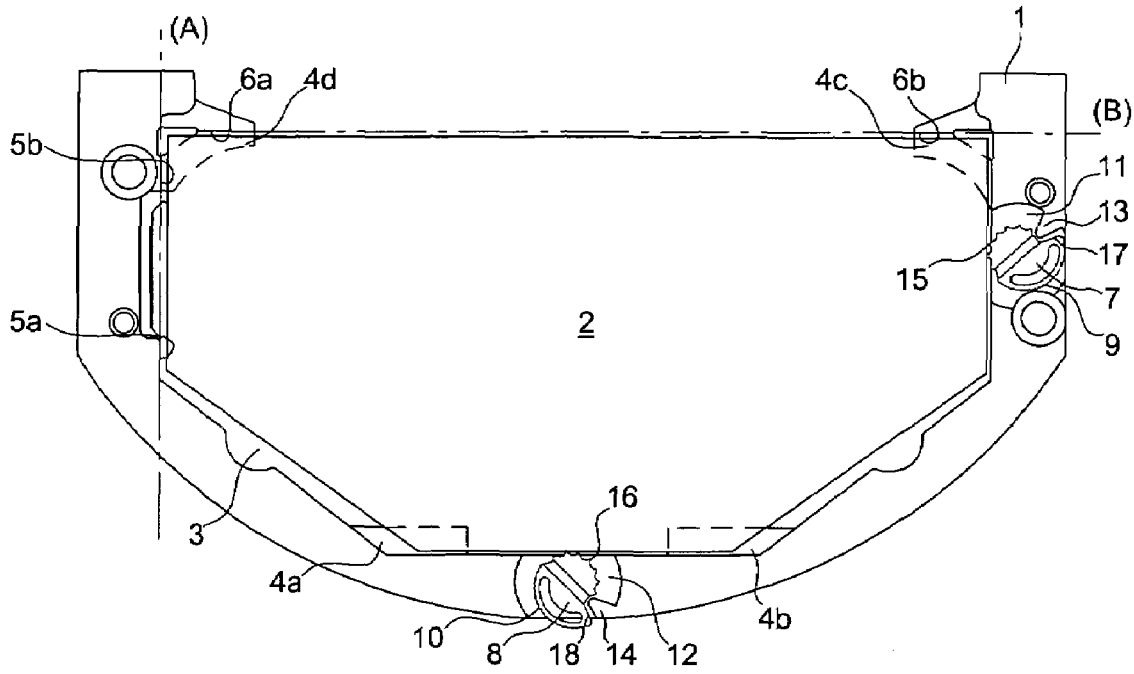
FIG. 1 shows a top view of a support piece in which the display means are arranged before precise positioning.

FIG. 1 shows a top view of a support piece 1 in which display means 2 are arranged prior to the precise positioning thereof on support piece 1.

It will be noted in this regard that support piece 1 is mounted in the watchcase in a fixed manner with respect to the dial and preferably along a mid-plane substantially parallel to the mid-plane of the dial.

Support piece 1 advantageously has a pattern cavity or recess 3 for receiving display means 2. Support elements 4*a*-4*d* are provided on the periphery of the cavity so as to hold display means 2, in a parallel plane to the mid-plane of the dial, namely advantageously in the mid-plane of support piece 1 (corresponding to the plane of the Figure).

Support piece 1 also has at least a first bearing or support surface, advantageously two bearing surfaces 5*a*-5*b*, along a first axis (A) in the mid-plane of support piece 1, and at least a second bearing surface, advantageously two bearing surfaces 6*a*-6*b*, along a second axis (B) also in the mid-plane of support piece 1 and preferably perpendicular to the first axis (A). Thus, the at least first 5*a*-5*b* and second 6*a*-6*b* bearing surfaces define a determined fixed position in the mid-plane of support piece 1, parallel to the mid-plane of the dial (not shown). This position is selected as a function of the position of the aperture of the dial.

It will be noted that advantageously the first bearing surfaces 5*a*-5*b* are widely spaced along the first axis (A) so as to ensure a stable support along the direction perpendicular to this first axis and that the second bearing surfaces 6*a*-6*b* are widely spaced along the second axis (B) so as to ensure a stable support along the direction perpendicular to said second axis (B).

In order to position the display means precisely then lock them in this position, first 7 and second 8 mechanical means are provided for moving the display means to abut against a stop respectively against the first 5*a*-5*b* and second 6*a*-6*b* bearing surfaces. These mechanical means 7 and 8 are arranged opposite the corresponding bearing surfaces with respect to cavity 3 of support piece 1.

Preferably, at least one of the first or second mechanical mans, and advantageously the first and the second mechanical means, are formed by mechanical means for converting a movement of rotation into a movement of translation.

Figure 3:
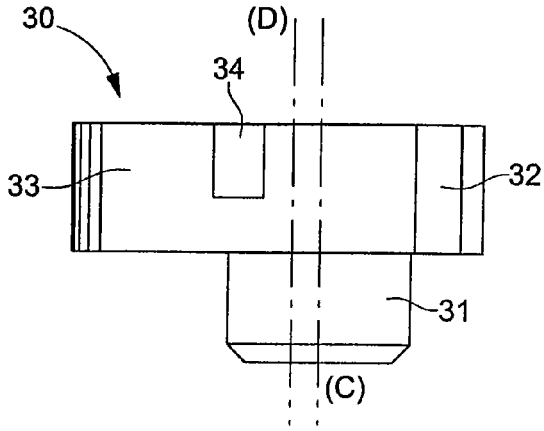
FIG. 3 shows a side view of a cam according to a preferred embodiment of the invention.
Figure 4:
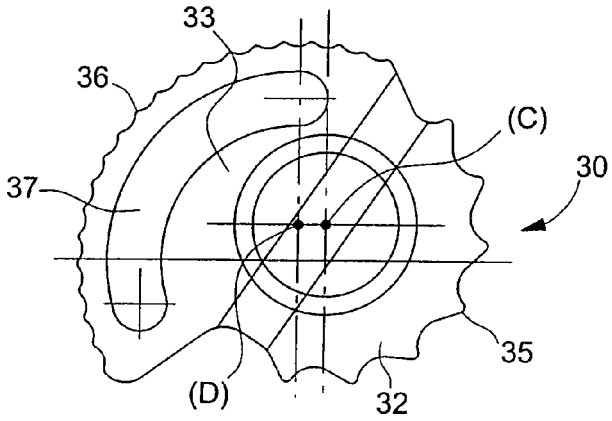
FIG. 4 shows a top view of a cam according to a preferred embodiment of the invention.

According to a preferred embodiment of the invention, cams 7 and 8, detailed views of which are provided in FIGS. 3 and 4, are used as mechanical means. These cams 7 and 8 have the advantage of only occupying a reduced space while allowing display means 2 to be moved over a distance depending upon the respective curved thrust surface 9-10 of each cam 7-8, sufficient to bring display means 2 to abut against the opposite bearing surfaces.

These cams 7 and 8 are arranged to be free in rotation, preferably in housings 11 and 12 provided for such purpose on support piece 1. By way of variant, it is possible to attach the cams onto the lower face of the dial arranged above the support piece.

In the example shown, housings 11 and 12 are each provided with a tooth 13-14 cooperating with a corresponding circular grooved portion 15-16 of cams 7-8 so as to ensure step-by-step rotation of the corresponding cam and consequently a gradual movement of display means 2. It will also be noted that at one end of each grooved portion 15-16 there is provided a stop surface 17-18 capable of abutting onto the corresponding tooth 13-14, as is illustrated in FIG. 1, in order to position cam 7-8 in its housing 9-10 before rotation, so as to indicate the direction of rotation for moving display means 2 towards the opposite bearing surfaces 5-6.

Figure 2:
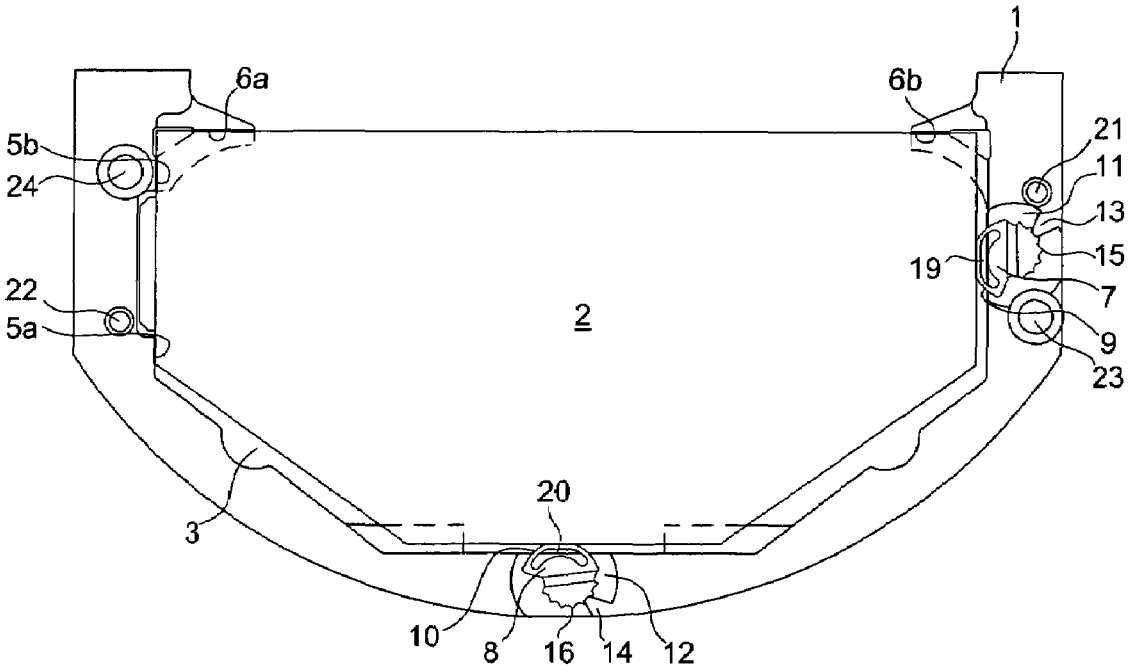
FIG. 2 shows a top view of a support piece in which the display means are arranged after precise positioning and locking of the latter.

FIG. 2 shows a similar view to that of FIG. 1, in which display means 2 have been moved to abut against the first 5*a*-5*b* and second 6*a*-6*b* bearing surfaces so that they are in the precise position defined by the bearing surfaces in relation to the aperture made in the watch dial. This position of display means 2 is achieved by actuating mechanical means, here cams 7 and 8 which have been rotated in the appropriate direction, i.e. that for moving display means 2 towards the opposite bearing surfaces 5*a*-5*b* and 6*a*-6*b*.

When the first cam 7 is rotated from its initial position shown in FIG. 1, the curved thrust surface 9 enters into contact with display means 2 and exerts a thrust perpendicularly to the axis (A) driving display means 2 in translation from their initial approximate position on support piece 1 towards a position in abutment against the opposite bearing surfaces 5*a*-5*b*.

Likewise, when the second cam 8 is rotated from its initial position shown in FIG. 1, the curved thrust surface 10 enters into contact with display means 2 and exerts a thrust perpendicularly to the axis (B) driving display means 2 from their initial approximate position on support piece 1 towards a position in abutment against the opposite bearing surfaces 6*a*-6*b*.

Thus, display means 2, as shown in FIG. 2, have been moved in abutment against the first 5*a*-5*b* and the second 6*a*-6*b* bearing surfaces and are thus positioned in the fixed position defined by said bearing surfaces in relation to the aperture in the watch dial.

It will be noted in this regard that the grooved portion 15-16 of cams 7-8 cooperating with tooth 13-14 of the corresponding housing 9-10 locks display means 2 in the fixed position, abutted against the opposite bearing surfaces 5-6. Moreover, advantageously, cams 7 and 8 comprise elastic means for absorbing the mechanical stress exerted on display means 2 in the fixed position. These elastic means are preferably made by means of a recess 19-20 made along the curved thrust surface 9-10.

After display means 2 have been precisely positioned and locked, they are fixed along the perpendicular axis to the mid-plane of support piece 1 by securing a light guide, not shown in FIGS. 1 and 2, above display means 2. The light guide can be secured by any known means, particularly by screwing, bonding or heat-welding. According to the example shown in FIG. 2, the light guide is placed above display means 2 by means of dog points 21 and 22, then secured by means of screws 23 and 24.

FIG. 3 shows an enlarged side view of a cam (7 or 8) in accordance with the preferred embodiment of the invention described in conjunction with FIGS. 1 and 2. The cam, bearing the general reference numeral 30, comprises a securing element 31 fixed in a hole made in the bottom of the support piece housing, so as to ensure that cam 30 is free in rotation about an axis (C) perpendicular to the mid-plane of the support piece. Cam 30 further includes, in its upper part, a substantially circular grooved portion 32 centred with respect to the axis of rotation (C) and a second portion 33, off-centre with respect to the axis of rotation (C) and centred with respect to the axis of rotation (D). A groove 34 is arranged on the upper part ensuring that cam 30 rotates easily, for example by means of a screwdriver.

FIG. 4 shows an enlarged top view of a cam (7 or 8) in accordance with the preferred embodiment of the invention described with reference to FIGS. 1 and 2. The same reference numerals have been used for the elements common to FIG. 3.

Grooved portion 32 of cam 30 has a toothing 35 capable of cooperating with the tooth of the corresponding housing, such elements being shown in FIGS. 1 and 2. The second portion 33 is centred about the axis (D) parallel to the axis of rotation (C) and has a curved thrust surface 36, preferably in the shape of a spiral, i.e. with an increasing radius in relation to the axis (D). This curved thrust surface 36 is for contacting the display means to move them in translation in the mid-plane of the support piece along a substantially perpendicular axis to the contact zone between surface 36 and the display means. It will be noted in this regard that thrust surface 36 is preferably slightly grooved to reduce the risk of the display means being damaged when they are moved. It will also be noted that advantageously the travel of the translation movement is obtained by the spiral form of thrust surface 36 and by its off-centre position with respect to the axis of rotation (C) of cam 30, which allows the size of the cam to be reduced for a determined length of movement. However, by way of variant, one can also envisage obtaining the desired movement of translation by using either a centred portion having a thrust surface with a spiral shape, or an off-centre portion having a substantially circular thrust surface. Nonetheless, for these two variants, the travel of the translation movement is smaller.

Cam 30 is advantageously provided with elastic means for absorbing the mechanical stress exerted on the display means locked in the fixed position. These elastic means are preferably formed by a recess 37 made along thrust surface 36 providing the latter with a determined elasticity as a function of requirements.

Another aspect of the invention concerns the method of mounting a display module in a portable electronic apparatus, like for example a watchcase. A display module means an assembly comprising in particular display means and a light guide.

This method of mounting a display module in a portable electronic apparatus comprises in particular the following steps:

arranging the display means on the support piece;

actuating one of the first or second mechanical means to move the display means in abutment against the corresponding bearing surface or surfaces;

actuating the other of the first or second mechanical means to move the display means in abutment against the other corresponding bearing surface or surfaces;

securing the light guide above the display means.

In the preferred example using cams, the steps of actuating the mechanical means correspond to the following steps:

rotating one or other of the cams to move the display means in abutment against the corresponding bearing surface or surfaces;

rotating the other cam to move the display means in abutment against the corresponding other bearing surface or surfaces.

It will be understood that various alterations and/or improvements evident to those skilled in the art can be made to the various embodiments of the invention described in the present description without departing from the scope of the invention defined by the annexed claims. In particular, the present invention is not limited solely to cams for moving the display means. Mechanical means like for example runners assuring a direct translation or even screws with their axis of rotation in the mid-plane of the support piece can be used to move the display means in abutment against the corresponding bearing surfaces.

What is claimed is:

1. A portable electronic apparatus including:

a case;

a dial provided with at least one aperture;

a support piece fixedly mounted in said case in relation to the dial along a substantially parallel plane to the mid-plane of the dial, arranged for receiving display means, said support piece having at least first and second bearing surfaces defining a fixed position for the display means in the support piece in relation to the aperture in the dial through which said display means are visible;

first and second mechanical means for moving said display means in abutment against said first and second bearing surfaces, respectively, in said fixed position that said surfaces define, wherein at least one of the first and second mechanical means are formed by mechanical means for converting a movement of rotation into a movement of translation.

2. The portable electronic apparatus according to claim 1, wherein at least one of said first and second mechanical means are formed by a cam whose axis of rotation is perpendicular to the mid-plane of the dial.

3. The portable electronic apparatus according to claim 2, wherein said at least one cam includes elastic means for absorbing mechanical stress exerted on the display means in the fixed position.

4. The portable electronic apparatus according to claim 3, wherein said elastic means are formed by a recess made in the cam along a thrust surface providing mechanical contact between the cam and the display means.

5. The portable electronic apparatus according to claim 1, wherein said display means are liquid crystal display means dimensioned to cover said aperture in the dial exactly, once moved into said fixed position.

6. The portable electronic apparatus according to claim 1, wherein the apparatus is a wristwatch.

7. A method of mounting a display module comprising display means and a light guide in a portable electronic apparatus according to claim 1, wherein the method includes the following steps:

arranging the display means on the support piece;

actuating one of the first or second mechanical means to move the display means in abutment against the corresponding bearing surface or surfaces;

actuating the other of the first or second mechanical means to move the display means in abutment against the other corresponding bearing surface or surfaces.

8. The mounting method according to claim 7, wherein the mechanical means are cams, and wherein the steps of actuating the mechanical means correspond to the following steps:

rotating one or other of the cams to move the display means in abutment against the corresponding bearing surface or surfaces; and rotating the other cam to move the display means in abutment against the corresponding other bearing surface or surfaces.

9. A portable electronic apparatus including:

a case;

a dial provided with at least one aperture;

a support piece fixedly mounted in said case in relation to the dial along a substantially parallel plane to the mid-plane of the dial, arranged for receiving display means, said support piece having at least first and second bearing surfaces defining a fixed position for the display means in the support piece in relation to the aperture in the dial; and first and second mechanical means for moving said display means in abutment against said first and second bearing surfaces, respectively, in said fixed position that said surfaces define, wherein at least one of the first and second mechanical means are formed by mechanical means for converting a movement of rotation into a movement of translation, wherein at least one of said first and second mechanical means are formed by a cam whose axis of rotation is perpendicular to the mid-plane of the dial, wherein said at least one cam is arranged to be free in rotation in a housing provided in the support piece and wherein said at least one cam includes a grooved circular portion cooperating with a tooth inside the housing so as to lock the cam in the fixed position.

10. The portable electronic apparatus according to claim 9, wherein said at least one cam includes a stop surface capable of pressing on the tooth inside of the housing to limit rotation of the cam in the housing.

* * * * *